US007064728B1

(12) United States Patent
Lin et al.

(10) Patent No.: US 7,064,728 B1
(45) Date of Patent: Jun. 20, 2006

(54) ULTRA-WIDEBAND DIPOLE ANTENNA

(75) Inventors: Sheng-Chih Lin, Taipei (TW); Tsung-Wen Chiu, Taipei (TW); Yun-Fan Bai, Taipei (TW); Fu-Ren Hsiao, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/113,179

(22) Filed: Apr. 25, 2005

(30) Foreign Application Priority Data

Dec. 24, 2004 (TW) ..... 93140545 A

(51) Int. Cl.
*H01Q 9/16* (2006.01)
*H01Q 9/04* (2006.01)

(52) U.S. Cl. ..... 343/792; 343/790; 343/791

(58) Field of Classification Search ..... 343/791, 343/792, 790, 715, 702; H01Q 9/16, 9/04
See application file for complete search history.

(56) References Cited

U.S. PATENT DOCUMENTS

| | | | | |
|---|---|---|---|---|
| 5,969,690 | A * | 10/1999 | Yamabayashi et al. | 343/792 |
| 6,177,911 | B1 * | 1/2001 | Yuda et al. | 343/792 |
| 6,421,024 | B1 * | 7/2002 | Stolle | 343/792 |
| 6,483,471 | B1 * | 11/2002 | Petros | 343/725 |
| 6,809,697 | B1 * | 10/2004 | Churng-Jou et al. | 343/792 |

* cited by examiner

*Primary Examiner*—Hoanganh Le
(74) *Attorney, Agent, or Firm*—Troxell Law Office, PLLC

(57) ABSTRACT

Provided is an ultra-wideband dipole antenna. In one embodiment, the antenna comprises a first outer sleeve, an intermediate sleeve surrounded by the first outer sleeve, a second outer sleeve above the first outer sleeve, a conductive interconnection interconnected the outer sleeves, and an inner coaxial conductor surrounded by the intermediate sleeve. A distance between the first outer sleeve and the intermediate sleeve can be changed for adjusting the generated capacitance for obtaining a required impedance matching in the resonance mode of an antenna operating bandwidth and an ultra-wideband characteristic. The antenna is particularly suitable for operating in a frequency range of 2.1 GHz to 11.7 GHz.

3 Claims, 7 Drawing Sheets

ULTRA-WIDEBAND DIPOLE ANTENNA

BACKGROUND OF THE INVENTION

1. Field of Invention The present invention relates to antennas and more particularly to an improved ultra-wideband dipole antenna mounted in a wireless communication device (e.g., cellular phone or PDA).

2. Description of Related Art

Wireless communication has known a rapid, spectacular development in recent years. Also, requirements for quality and performance of antenna mounted in a wireless communication device (e.g., cellular phone or PDA) are increased. In addition to the requirement of miniature antenna, multiple frequency band or ultra-wideband feature is also necessary. For many types of newly developed wireless communication devices, having an ultra-wideband antenna is critical for high speed wireless transmission of image data or large amount of data.

A conventional dipole antenna is shown in FIG. 1 and comprises an inner metal conductor 13 having a feed point location 131 at one end thereof, a coaxial conductor 14 having a central conductor 141 electrically connected to the feed point location 131 to form a positive terminal of the antenna, and a metal sleeve 12 connected to an outer grounding cylinder 142 of the coaxial conductor 14 to form a negative terminal of the antenna.

The prior dipole antenna is applicable for a single frequency band operation only and has a bandwidth about 10% to 12% of central frequency of resonance. For example, the dipole antenna operates in a single frequency band in a wireless LAN having a frequency 2.45 GHz and has a bandwidth about 250 MHz. As such, the prior dipole antenna does not meet the requirements for multiple frequency band or ultra-wideband applications. Thus, the need for improvement still exists in order to overcome the inadequacy of the prior art.

SUMMARY OF THE INVENTION

It is therefore an object of the present invention to provide an ultra-wideband dipole antenna. In a positive portion of the antenna, there are provided with a conductive interconnection and a metal sleeve to form a conductive post with substantially increased diameter for increasing impedance matching of the antenna. In a negative portion of the antenna, another metal sleeve is electrically connected to an outer conductive shell of a coaxial conductor for generating a base band resonance mode and a plurality of high frequency resonance modes of the dipole antenna. Moreover, one or two incorporated outer metal sleeves are able to generate a plurality of resonance modes due to its electromagnetic coupling characteristic. In addition, radius of each outer metal sleeve and a spacing between two outer metal sleeves are adapted to control a capacitive effect such that the antenna is adapted to operate in a frequency range of the plurality of electromagnetic coupling resonance modes within a required operating bandwidth. Thus, a predetermined impedance matching in the resonance mode of an antenna operating bandwidth is obtained. Also, an ultra-wideband characteristic of the antenna is formed. The dipole antenna of the invention is sufficient to operate in a frequency range of 2.1 GHz to 11.7 GHz as required in the existing ultra-wideband antenna. The dipole antenna of the present invention is able to significantly increase an operating frequency without increasing antennal height.

To achieve the above and other objects, the present invention provides an ultra-wideband dipole antenna comprising a generally axially disposed first outer metal sleeve having a first closed face at a top end thereof opposite its open bottom end, and a first hole through the first closed face; a generally axially disposed intermediate metal sleeve surrounded by the first outer metal sleeve, the intermediate metal sleeve having a second closed face at a top end thereof opposite its open bottom end, and a second hole through the second closed face; a generally axially disposed second outer metal sleeve above the first outer metal sleeve, the second outer metal sleeve having a third closed face at a bottom end thereof opposite its open top end; a conductive interconnection having a bottom end extended through the first hole, a feed point location at its bottom end, and a top end electrically connected to the third closed face; and an inner coaxial conductor surrounded by the intermediate metal sleeve, the coaxial conductor including a central conductor electrically connected to the feed point location and an outer grounding sleeve surrounding the central conductor and electrically connected to edges of the second hole wherein the dipole antenna is formed by the intermediate metal sleeve, the conductive interconnection, and the second outer metal sleeve and is adapted to generate a base band resonance mode and a plurality of high frequency resonance modes, an impedance matching between a base band resonance mode and one of a plurality of high frequency resonance modes is defined by length of the conductive interconnection and radii and lengths of both the intermediate metal sleeve and the second outer metal sleeve, the first outer metal sleeve is adapted to generate a plurality of resonance modes due to its electromagnetic coupling characteristic, radius and length of the first outer metal sleeve are adapted to control a frequency range of the plurality of resonance modes within a predetermined operating bandwidth, and a distance between the first outer metal sleeve and the intermediate metal sleeve is adapted to change for adjusting the generated capacitance for obtaining a predetermined impedance matching in the resonance mode of an antenna operating bandwidth and an ultra-wideband characteristic. The ultra-wideband dipole antenna is particularly suitable for operating in a frequency range of 2.1 GHz to 11.7 GHz.

The above and other objects, features and advantages of the present invention will become apparent from the following detailed description taken with the accompanying drawings.

DETAILED DESCRIPTION OF THE INVENTION

Figure 1:
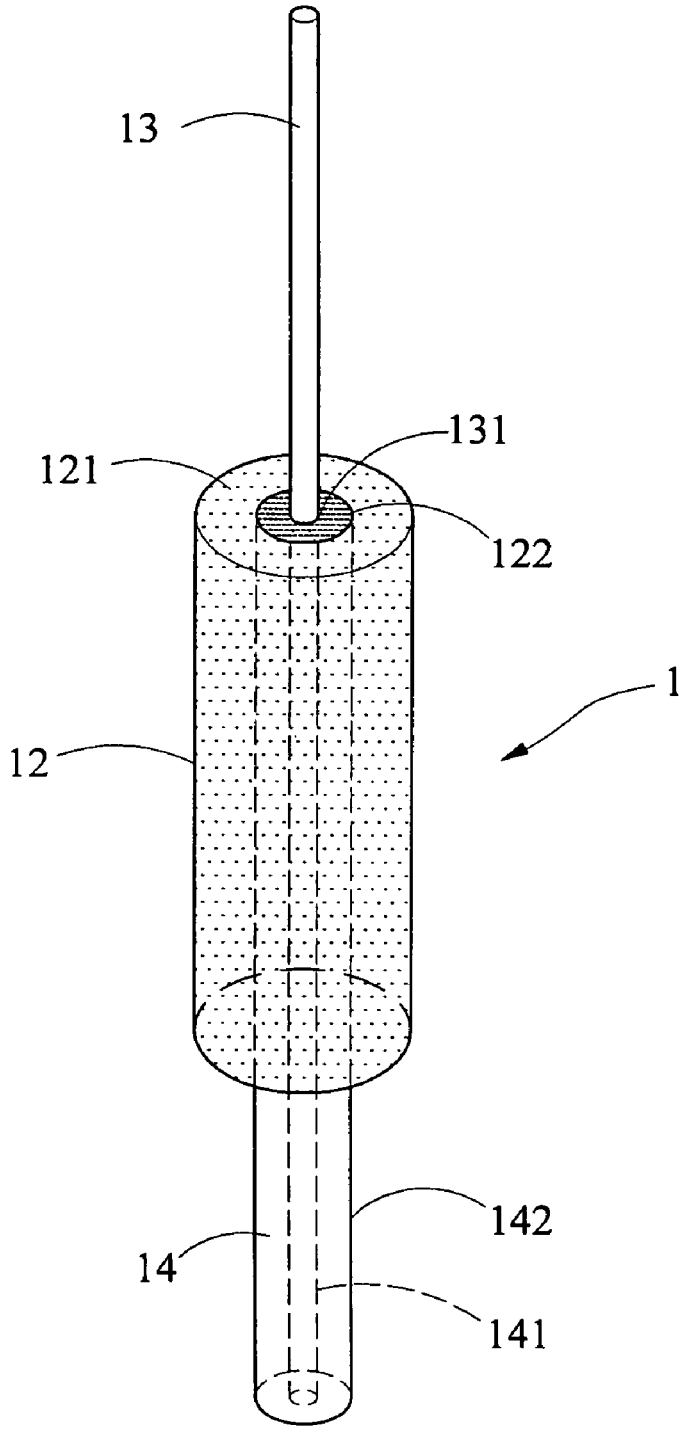
FIG. 1(Prior Art)
FIG. 1 is a schematic perspective view of a conventional dipole antenna.
Figure 2:
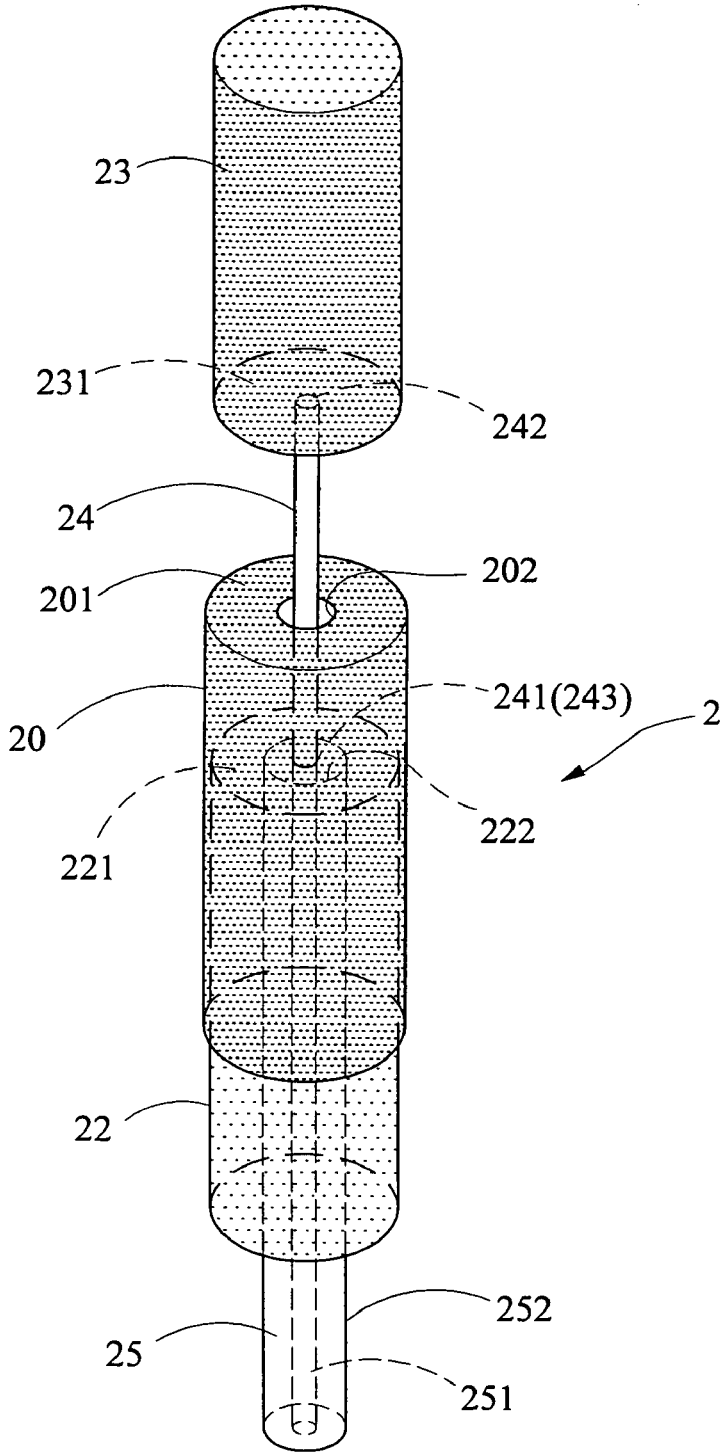
FIG. 2 is a schematic perspective view of a first preferred embodiment of ultra-wideband dipole antenna according to the invention.
Figure 3:
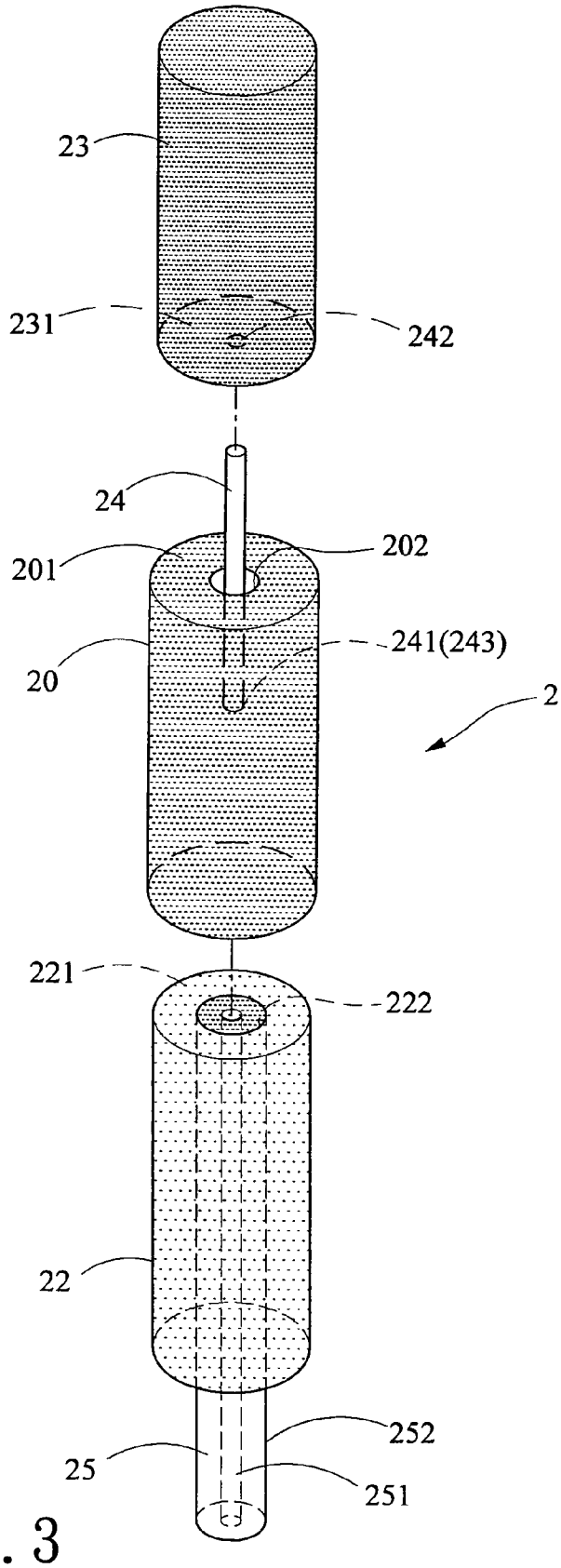
FIG. 3 is an exploded view of the dipole antenna in FIG. 2.

Referring to FIGS. 2 and 3, there is shown an ultra-wideband dipole antenna 2 in accordance with a first preferred embodiment of the invention comprising a generally axially disposed first outer metal sleeve 20 having a closed face 201 at a top end thereof opposite its open bottom end, and a hole 202 through the closed face 201; a generally axially disposed intermediate metal sleeve 22 dimensioned to be surrounded by the first outer metal sleeve 20, the intermediate metal sleeve 22 having a closed face 221 at a top end thereof opposite its open bottom end, and a hole 222 through the closed face 221; a generally axially disposed second outer metal sleeve 23 above the first outer metal sleeve 20, the second outer metal sleeve 23 having a closed face 231 at a bottom end thereof opposite its open top end; a conductive interconnection 24 having a bottom end 241 extended through the hole 202, a feed point location 243 at the bottom end 241, and a top end 242 electrically connected to the closed face 231; and an inner coaxial conductor 25 surrounded by the intermediate metal sleeve 22, the coaxial conductor 25 including a central conductor 251 electrically connected to the feed point location 243 and an outer grounding sleeve 252 surrounding the central conductor 251 and electrically connected to edges of the hole 222.

In the embodiment, a diameter of the first outer metal sleeve 20 is larger than that of the intermediate metal sleeve 22. An inner wall of the first outer metal sleeve 20 is engaged with an outer wall of the intermediate metal sleeve 22. A dipole antenna formed by the intermediate metal sleeve 22, the conductive interconnection 24, and the second outer metal sleeve 23 is able to generate a base band resonance mode and a plurality of high frequency resonance modes. Moreover, impedance matching between the base band resonance mode and the high frequency resonance mode is defined by length of the conductive interconnection 24 and radii and lengths of both the intermediate metal sleeve 22 and the second outer metal sleeve 23. The first outer metal sleeve 20 surrounding the intermediate metal sleeve 22 is able to generate a plurality of resonance modes due to its electromagnetic coupling characteristic. Moreover, radius and length of the first outer metal sleeve 20 are adapted to control a frequency range of the plurality of electromagnetic coupling resonance modes within a required operating bandwidth. In addition, a distance between the first outer metal sleeve 20 and the intermediate metal sleeve 22 can be changed for adjusting the generated capacitance so as to obtain an excellent impedance matching in the resonance mode of the antenna operating bandwidth and an ultra-wideband feature.

Figure 4:
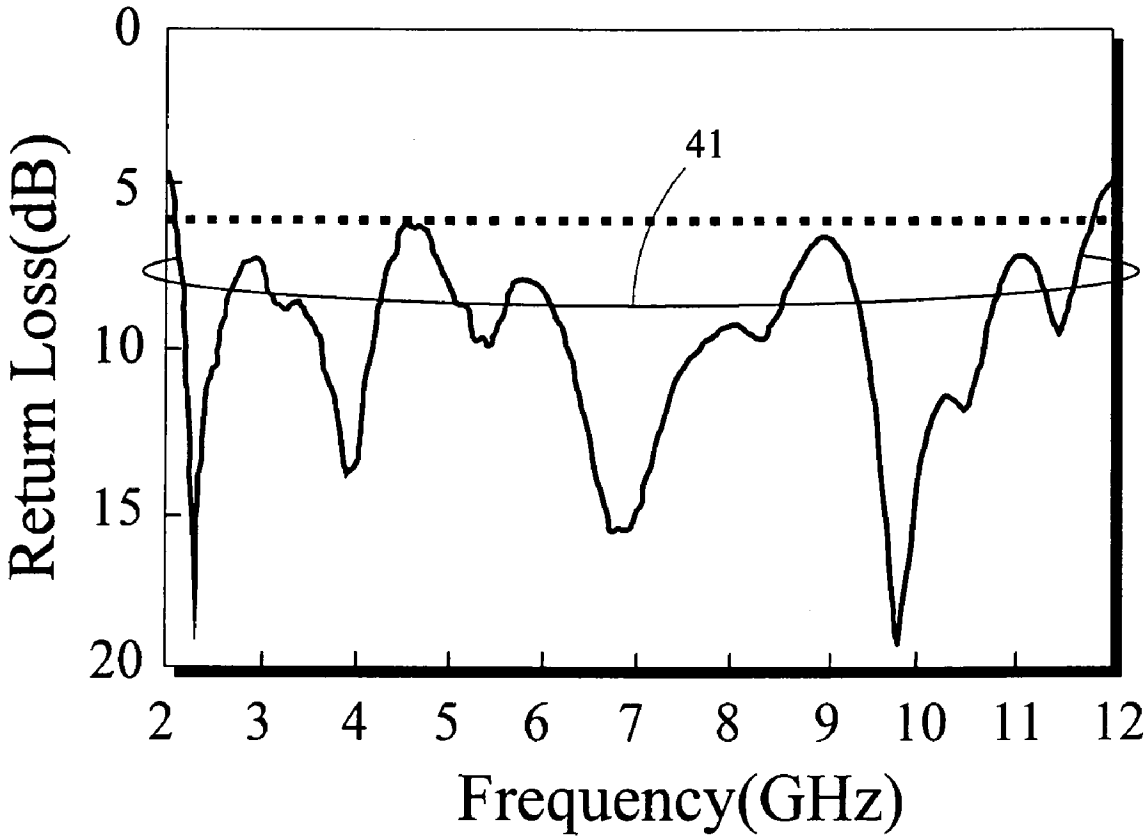
FIG. 4 plots return loss versus frequency according to the first preferred embodiment of ultra-wideband dipole antenna of the invention.

Referring to FIG. 4, this graph is drawn based on a return loss measurement experiment conducted according to the first preferred embodiment of ultra-wideband dipole antenna of the invention. Curve 41 represents an ultra-wideband operating frequency of the antenna. The bandwidth of the antenna is about 9.6 GHz in the range of 2.1 GHz to 11.7 GHz when the antenna operates in 3:1 VSWR (voltage standing wave ratio) impedance bandwidth. It is clear that the dipole antenna of the invention is sufficient to meet the bandwidth requirements of existing ultra-wideband communication systems.

Figure 5:
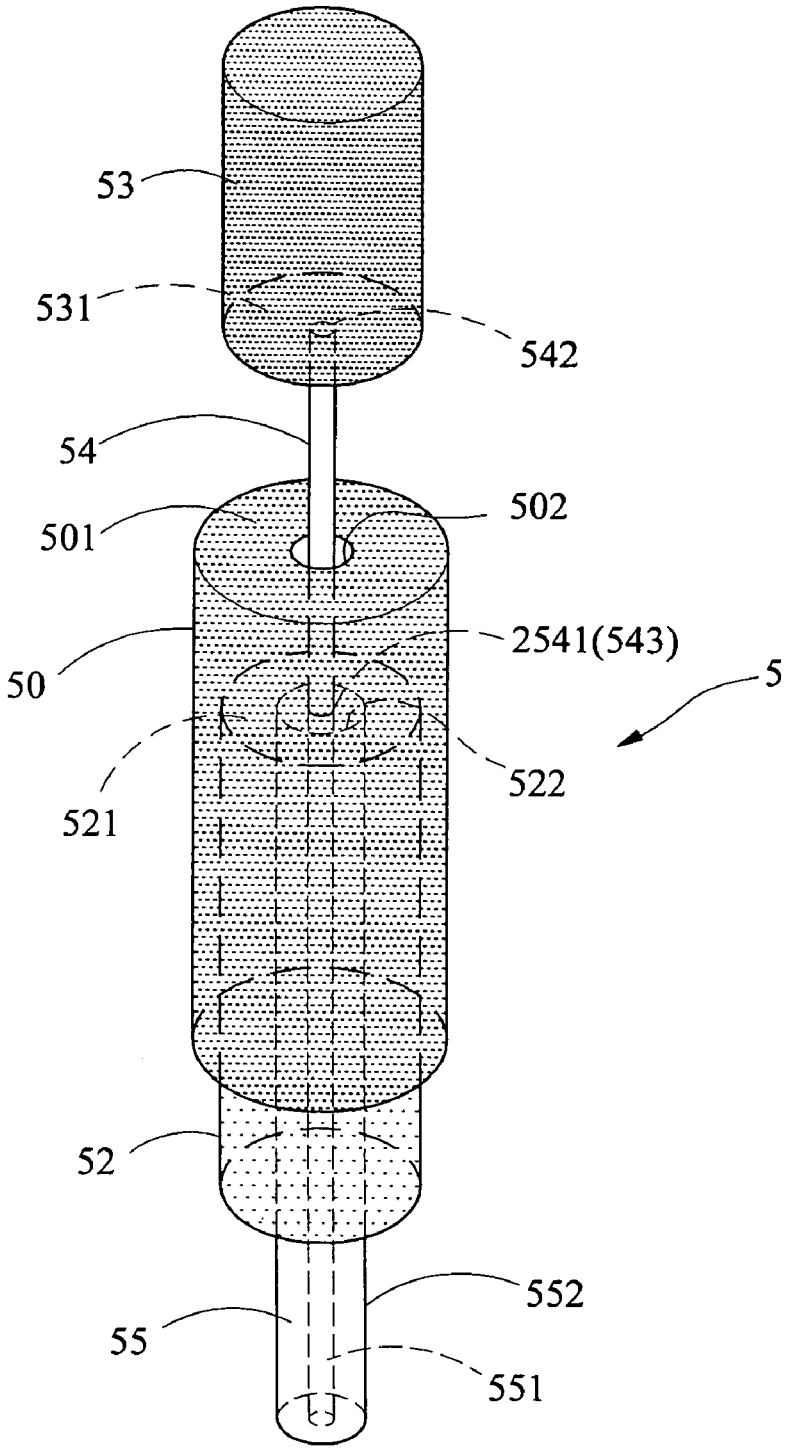
FIG. 5 is a schematic perspective view of a second preferred embodiment of ultra-wideband dipole antenna according to the invention.

Referring to FIG. 5, it shows a second preferred embodiment of ultra-wideband dipole antenna 5 according to the invention. The second preferred embodiment substantially has same construction as the first preferred embodiment. The differences between the first and the second preferred embodiments, i.e., the characteristics of the second preferred embodiment are detailed below. The dipole antenna 5 comprises a generally axially disposed first outer metal sleeve 50 having a closed face 501 at a top end thereof opposite its open bottom end, and a hole 502 through the closed face 501; a generally axially disposed intermediate metal sleeve 52 dimensioned to be surrounded by the first outer metal sleeve 50 and spaced therefrom by a radial gap, the intermediate metal sleeve 52 having a closed face 521 at a top end thereof opposite its open bottom end, and a hole 522 through the closed face 521; a generally axially disposed second outer metal sleeve 53 above the first outer metal sleeve 50, the second outer metal sleeve 53 having a closed face 531 at a bottom end thereof opposite its open top end; a conductive interconnection 54 having a bottom end 541 extended through the hole 502, a feed point location 543 at the bottom end 541, and a top end 542 electrically connected to the closed face 531; and an inner coaxial conductor 55 surrounded by the intermediate metal sleeve 52, the coaxial conductor 55 including a central conductor 551 electrically connected to the feed point location 543 and an outer grounding sleeve 552 surrounding the central conductor 551 and electrically connected to edges of the hole 522.

In the embodiment, a diameter of the first outer metal sleeve 50 is larger than that of the intermediate metal sleeve 52. An inner wall of the first outer metal sleeve 50 is not engaged with an outer wall of the intermediate metal sleeve 52. A dipole antenna formed by the intermediate metal sleeve 52, the conductive interconnection 54, and the second outer metal sleeve 53 is able to generate a base band resonance mode and a plurality of high frequency resonance modes. Moreover, impedance matching between the base band resonance mode and the high frequency resonance mode is defined by length of the conductive interconnection 54 and radii and lengths of both the intermediate metal sleeve 52 and the second outer metal sleeve 53. The first outer metal sleeve 50 surrounding the intermediate metal sleeve 52 is able to generate a plurality of resonance modes due to its electromagnetic coupling characteristic. Moreover, radius and length of the first outer metal sleeve 50 are adapted to control a frequency range of the plurality of electromagnetic coupling resonance modes within a required operating bandwidth. In addition, a distance between the first outer metal sleeve 50 and the intermediate metal sleeve 52 can be changed for adjusting the generated capacitance so as to obtain an excellent impedance matching in the resonance mode of the antenna operating bandwidth and an ultra-wideband feature.

Figure 6:
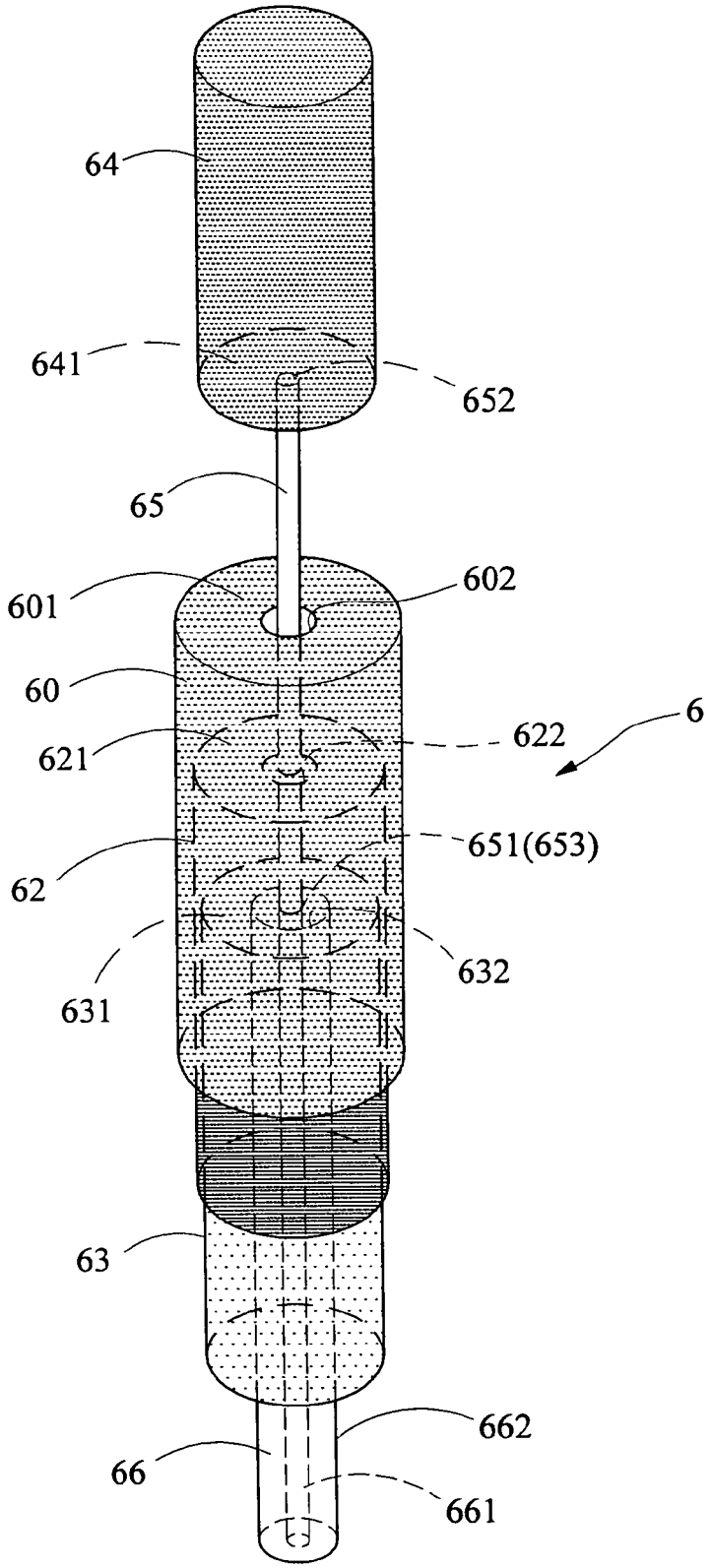
FIG. 6 is a schematic perspective view of a third preferred embodiment of ultra-wideband dipole antenna according to the invention.

Referring to FIG. 6, it shows a third preferred embodiment of ultra-wideband dipole antenna 6 according to the invention. The characteristics of the third preferred embodiment are detailed below. The dipole antenna 6 comprises a generally axially disposed first outer metal sleeve 60 having a closed face 601 at a top end thereof opposite its open bottom end, and a hole 602 through the closed face 601; a generally axially disposed intermediate metal sleeve 62 dimensioned to be surrounded by the first outer metal sleeve 60 and spaced therefrom by a radial gap, the intermediate metal sleeve 62 having a closed face 621 at a top end thereof opposite its open bottom end, and a hole 622 through the closed face 621; a generally axially disposed inner metal sleeve 63 dimensioned to be surrounded by the intermediate metal sleeve 62, the inner metal sleeve 63 having a closed face 631 at a top end thereof opposite its open bottom end, and a hole 632 through the closed face 631; a generally axially disposed second outer metal sleeve 64 above the first outer metal sleeve 60, the second outer metal sleeve 64 having a closed face 641 at a bottom end thereof opposite its open top end; a conductive interconnection 65 having a bottom end 651 extended through the hole 602, a feed point location 653 at the bottom end 651, and a top end 652 electrically connected to the closed face 641; and an inner coaxial conductor 66 surrounded by the intermediate metal sleeve 62, the coaxial conductor 66 including a central conductor 661 electrically connected to the feed point location 653 and an outer grounding sleeve 662 surrounding the central conductor 661 and electrically connected to edges of the hole 632.

In the embodiment, a diameter of the first outer metal sleeve 60 is larger than that of the intermediate metal sleeve 62. An inner wall of the first outer metal sleeve 60 is not engaged with an outer wall of the intermediate metal sleeve 62. A diameter of the intermediate metal sleeve 62 is larger than that of the inner metal sleeve 63. An inner wall of the intermediate metal sleeve 62 is engaged with an outer wall of the inner metal sleeve 63. A dipole antenna formed by the inner metal sleeve 63, the conductive interconnection 65, and the second outer metal sleeve 64 is able to generate a base band resonance mode and a plurality of high frequency resonance modes. Moreover, impedance matching between the base band resonance mode and the high frequency resonance mode is defined by length of the conductive interconnection 65 and radii and lengths of both the intermediate metal sleeve 62 and the second outer metal sleeve 64. The first outer metal sleeve 60 and the intermediate metal sleeve 62 surrounding the inner metal sleeve 63 are able to generate a plurality of resonance modes due to its electromagnetic coupling characteristic. Moreover, radii and lengths of the first outer metal sleeve 60 and the intermediate metal sleeve 62 are adapted to control a frequency range of the plurality of electromagnetic coupling resonance modes within a required operating bandwidth. In addition, a distance between the first outer metal sleeve 60 and the intermediate metal sleeve 62, a distance between the intermediate metal sleeve 62 and the inner metal sleeve 63, and radii of the first outer metal sleeve 60 and the intermediate metal sleeve 62 can be changed for adjusting the generated capacitance so as to obtain an excellent impedance matching in the resonance mode of the antenna operating bandwidth and an ultra-wideband feature.

Figure 7:
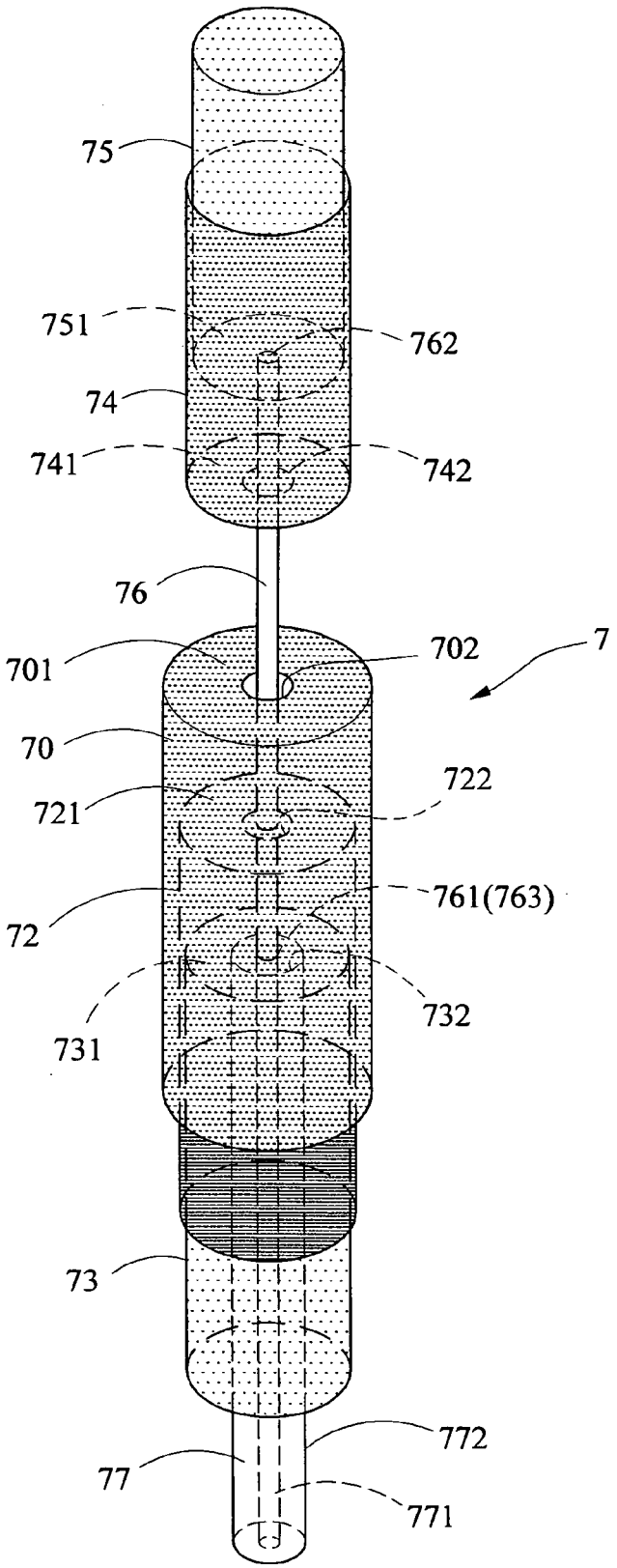
FIG. 7 is a schematic perspective view of a fourth preferred embodiment of ultra-wideband dipole antenna according to the invention.

Referring to FIG. 7, it shows a fourth preferred embodiment of ultra-wideband dipole antenna 7 according to the invention. The fourth preferred embodiment substantially has same construction as the third preferred embodiment. The differences between the third and the fourth preferred embodiments, i.e., the characteristics of the fourth preferred embodiment are detailed below. The dipole antenna 7 comprises a generally axially disposed first outer metal sleeve 70 having a closed face 701 at a top end thereof opposite its open bottom end, and a hole 702 through the closed face 701; a generally axially disposed intermediate metal sleeve 72 dimensioned to be surrounded by the first outer metal sleeve 70 and spaced therefrom by a radial gap, the intermediate metal sleeve 72 having a closed face 721 at a top end thereof opposite its open bottom end, and a hole 722 through the closed face 721; a generally axially disposed first inner metal sleeve 73 dimensioned to be surrounded by the intermediate metal sleeve 72, the first inner metal sleeve 73 having a closed face 731 at a top end thereof opposite its open bottom end, and a hole 732 through the closed face 731; a generally axially disposed second outer metal sleeve 74 above the first outer metal sleeve 70, the second outer metal sleeve 74 having a closed face 741 at a bottom end thereof opposite its open top end, and a hole 742 through the closed face 741; a generally axially disposed second inner metal sleeve 75 surrounded by the second outer metal sleeve 74, the second inner metal sleeve 75 having a closed face 751 at a bottom end thereof opposite its open top end; a conductive interconnection 76 having a bottom end 761 extended through the holes 722 and 702, a feed point location 763 at the bottom end 761, and a top end 762 extended through the hole 742 to electrically connect to the closed face 751; and an inner coaxial conductor 77 surrounded by the first inner metal sleeve 73, the coaxial conductor 77 including a central conductor 771 electrically connected to the feed point location 763 and an outer grounding sleeve 772 surrounding the central conductor 771 and electrically connected to edges of the hole 732.

In the embodiment, a diameter of the first outer metal sleeve 70 is larger than that of the intermediate metal sleeve 72, a diameter of the intermediate metal sleeve 72 is larger than that of the first inner metal sleeve 73, and a diameter of the second outer metal sleeve 74 is larger than that of the second inner metal sleeve 75 respectively. An inner wall of the first outer metal sleeve 70 is not engaged with an outer wall of the intermediate metal sleeve 72. An inner wall of the intermediate metal sleeve 72 is engaged with an outer wall of the first inner metal sleeve 73. An inner wall of the second outer metal sleeve 74 is engaged with an outer wall of the second inner metal sleeve 75. A dipole antenna formed by the first inner metal sleeve 73, the conductive interconnection 76, and the second inner metal sleeve 75 is able to generate a base band resonance mode and a plurality of high frequency resonance modes. Moreover, impedance matching between the base band resonance mode and the high frequency resonance mode is defined by length of the conductive interconnection 76 and radii and lengths of both the first inner metal sleeve 73 and the second inner metal sleeve 75. The first outer metal sleeve 70 and the intermediate metal sleeve 72 surrounding the first inner metal sleeve 73, and the second outer metal sleeve 74 surrounding the second inner metal sleeve 75 are able to generate a plurality of resonance modes due to its electromagnetic coupling characteristic. Moreover, radii and lengths of the first outer metal sleeve 70 and the intermediate metal sleeve 72 are adapted to control a frequency range of the plurality of electromagnetic coupling resonance modes within a required operating bandwidth. In addition, a distance between the first outer metal sleeve 70 and the intermediate metal sleeve 72, a distance between the intermediate metal sleeve 72 and the first inner metal sleeve 73, a distance between the second outer metal sleeve 74 and the second inner metal sleeve 75, and radii of the first outer metal sleeve 70, the intermediate metal sleeve 72, and the second outer metal sleeve 74 can be changed for adjusting the generated capacitance so as to obtain an excellent impedance matching in the resonance mode of the antenna operating bandwidth and an ultra-wideband feature.

While the invention herein disclosed has been described by means of specific embodiments, numerous modifications and variations could be made thereto by those skilled in the art without departing from the scope and spirit of the invention set forth in the claims.

What is claimed is:

1. An ultra-wideband dipole antenna comprising:

a generally axially disposed first outer metal sleeve having a first closed face located at a top end thereof opposite an open bottom end, and a first hole through the first closed face;

a generally axially disposed intermediate metal sleeve surrounded by the first outer metal sleeve, the intermediate metal sleeve having a second closed face located at a top end thereof opposite an open bottom end, and a second hole through the second closed face, wherein the second closed face is separated from the first closed face and the first closed face is located higher than the second closed face with a predetermined space;

a generally axially disposed second outer metal sleeve above the first outer metal sleeve, the second outer metal sleeve having a third closed face located at a bottom end thereof opposite an open top end;

a conductive interconnection having a bottom end extended through the first hole, a feed point location located at a bottom end located within the first outer metal sleeve, and a top end thereof electrically connected to the third closed face; and an inner coaxial conductor surrounded by the intermediate metal sleeve, the coaxial conductor including a central conductor having a top end electrically connected to the feed point location and an outer grounding sleeve surrounding the central conductor and having a top end electrically connected to edges of the second hole.

2. An ultra-wideband dipole antenna comprising:

a generally axially disposed first outer metal sleeve having a first closed face located at a top end thereof opposite an open bottom end, and a first hole through the first closed face;

a generally axially disposed intermediate metal sleeve surrounded by the first outer metal sleeve and spaced therefrom by a predetermined radial gap, the intermediate metal sleeve having a second closed face located at a top end thereof opposite an open bottom end, and a second hole through the second closed face, wherein the second closed face is separated from the first closed face and the first closed face is located higher than the second closed face with a predetermined space;

a generally axially disposed inner metal sleeve dimensioned to be surrounded by the intermediate metal sleeve, the inner metal sleeve having a closed face located at a top end thereof opposite an open bottom end, and a third hole through the closed face, wherein the third closed face is separated from the second closed face and the second closed face is located higher than the third closed face with a predetermined space;

a generally axially disposed second outer metal sleeve above the first outer metal sleeve, the second outer metal sleeve having a third closed face located at a bottom end thereof opposite an open top end;

a conductive interconnection having a bottom end extended through the first hole, a feed point location located at an bottom end located within the intermediate metal sleeve, and a top end thereof electrically connected to the third closed face; and an inner coaxial conductor surrounded by the intermediate metal sleeve, the coaxial conductor including a central conductor having a top end electrically connected to the feed point location and an outer grounding sleeve surrounding the central conductor and having a top end electrically connected to edges of the third hole.

3. An ultra-wideband dipole antenna comprising:

a generally axially disposed first outer metal sleeve having a first closed face located at a top end thereof opposite an open bottom end, and a first hole through the first closed face;

a generally axially disposed intermediate metal sleeve surrounded by the first outer metal sleeve and spaced therefrom by a predetermined radial gap, the intermediate metal sleeve having a second closed face located at a top end thereof opposite an open bottom end, and a second hole through the second closed face, wherein the second closed face is separated from the first closed face and the first closed face is located higher than the second closed face with a predetermined space;

a generally axially disposed first inner metal sleeve surrounded by the intermediate metal sleeve, the first inner metal sleeve having a third closed face located at a top end thereof opposite an open bottom end, and a third hole through the third closed face, wherein the third closed face is separated from the second closed face and the second closed face is located higher than the third closed face with a predetermined space;

a generally axially disposed second outer metal sleeve above the first outer metal sleeve, the second outer metal sleeve having a fourth closed face located at a bottom end thereof opposite an open top end, and a fourth hole through the fourth closed face;

a generally axially disposed second inner metal sleeve surrounded by the second outer metal sleeve, the second inner metal sleeve having a fifth closed face located at a bottom end thereof opposite an open top end, wherein the fifth closed face is separated from and above the fourth closed face with a predetermined space;

a conductive interconnection having a bottom end extended through the first and second holes, a feed point location located at an bottom end located within the intermediate metal sleeve, and a top end extended through the fourth hole to electrically connect to the fifth closed face; and an inner coaxial conductor surrounded by the first inner metal sleeve, the coaxial conductor including a central conductor having a top end electrically connected to the feed point location and an outer grounding sleeve surrounding the central conductor and having a top end electrically connected to edges of the third hole.

* * * * *